US008315533B2

(12) United States Patent
Iwanami et al.

(10) Patent No.: US 8,315,533 B2
(45) Date of Patent: Nov. 20, 2012

(54) DEVELOPING DEVICE AND IMAGE-FORMING APPARATUS

(75) Inventors: Toru Iwanami, Ebina (JP); Gen Nakajima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 333 days.

(21) Appl. No.: 12/728,492

(22) Filed: Mar. 22, 2010

(65) Prior Publication Data

US 2011/0052223 A1 Mar. 3, 2011

(30) Foreign Application Priority Data

Aug. 26, 2009 (JP) ..... 2009-195804

(51) Int. Cl.
*G03G 15/01* (2006.01)
*G03G 15/10* (2006.01)

(52) U.S. Cl. ..... 399/58; 399/227

(58) Field of Classification Search ..... 399/30, 399/58, 74, 227
See application file for complete search history.

(56) References Cited

U.S. PATENT DOCUMENTS 7,239,815 B2 * 7/2007 Takahashi ..... 399/12

FOREIGN PATENT DOCUMENTS

| | | | |
|---|---|---|---|
| JP | 59-100471 | A | 6/1984 |
| JP | 01-253769 | A | 10/1989 |
| JP | 2000-231255 | A | 8/2000 |

* cited by examiner

*Primary Examiner* — David Gray
*Assistant Examiner* — Gregory H Curran
(74) *Attorney, Agent, or Firm* — Sughrue Mion, PLLC

(57) ABSTRACT

A developing device comprises a developer unit that contains a developer including a color material and a magnetic powder, the color material being used to develop an electrostatic latent image held by an image holding member; a collecting unit that collects a part of the developer contained in the developer unit via a passage; and a measuring unit that measures a concentration of the color material included in the developer based on a magnetic property of the developer moving through the passage.

10 Claims, 9 Drawing Sheets

DEVELOPING DEVICE AND IMAGE-FORMING APPARATUS

CROSS-REFERENCE TO RELATED APPLICATIONS

This application is based on and claims priority under 35 U.S.C. 119 from Japanese Patent Application No. 2009-195804, which was filed on Aug. 26, 2009.

BACKGROUND

1. Technical Field

The present invention relates to a developing device and an image-forming apparatus.

2. Related Art

Among developing devices that use a two-component developer; that is, a developer containing a toner as a color material and a magnetic powder as a carrier, a so-called trickle-type developing device is known. A trickle-type developing device uses a technique of supplying two-component developer while discharging any excess two-component developer from a discharge port, to thereby prevent degradation of the two-component developer that could result from stirring of developer over an extended period of time.

Also known is a so-called rotary developing device, which comprises plural developer units that rotate as a unitary body to develop an electrostatic latent image formed on a surface of a photosensitive body. In such a rotary developing device, it is known to measure a mixture ratio of components of the accommodated two-component developer based on a change in magnetic permeability and to control the mixture ratio to maintain stability of image density.

SUMMARY

In one aspect of the present invention, there is provided a developing device comprising a developer unit that contains a developer including a color material and a magnetic powder, the color material being used to develop an electrostatic latent image held by an image holding member; a collecting unit that collects a part of the developer contained in the developer unit via a passage; and a measuring unit that measures a concentration of the color material included in the developer based on a magnetic property of the developer moving through the passage.

BRIEF DESCRIPTION OF THE DRAWINGS

Exemplary embodiments of the present invention will be described in detail based on the following figures, wherein.

DETAILED DESCRIPTION

(1) Configuration

Figure 1:
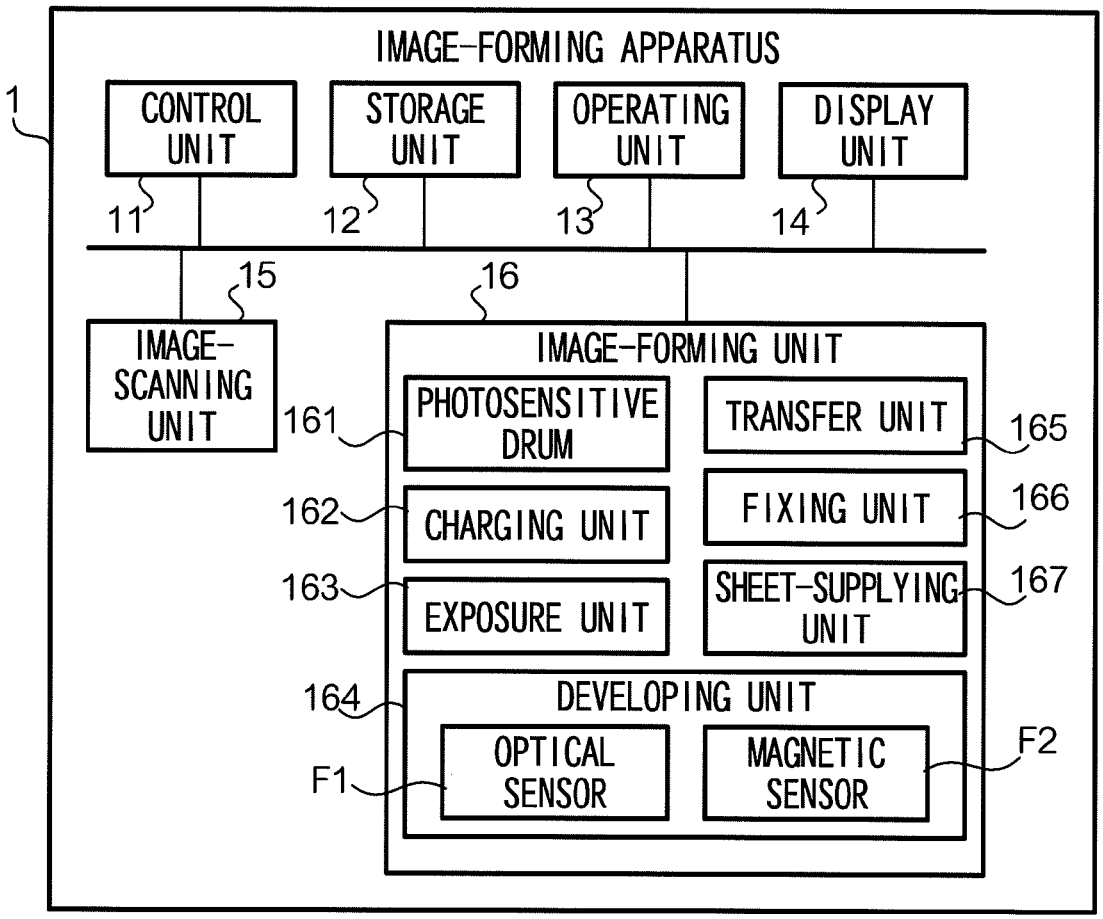
FIG. 1 is a block diagram showing a configuration of image-forming apparatus 1 according to an exemplary embodiment of the present invention.

FIG. 1 is a block diagram showing a configuration of image-forming apparatus 1 according to an exemplary embodiment of the present invention.

Image-forming apparatus 1 is provided with a variety of functions such as printing, scanning, and copying, and can form an image on a recording sheet, which is an example of a recording medium, with a toner, which is an example of a color material, and scan an image formed on a sheet. Image-forming apparatus 1 includes control unit 11, storage unit 12, operating unit 13, display unit 14, image-scanning unit 15, and image-forming unit 16.

Control unit 11 includes a CPU (Central Processing Unit), ROM (Read Only Memory), and RAM (Random Access Memory), and the CPU executes a program stored in the ROM or storage unit 12 to control various parts of image-forming apparatus 1. Storage unit 12 is an auxiliary storage device of non-volatile type such as a HD (Hard Disk), and stores various types of programs and data. Operating unit 13 includes a power switch and a variety of keys to receive operations of a user and provide signals in accordance with the operations to control unit 11. Display unit 14 includes a VRAM (Video RAM), LCD (Liquid Crystal Display) and driving circuit for the LCD, and displays a variety of information, such as a process execution state or user operation guidance, according to the information provided from control unit 11. Image-scanning unit 15 is equipped with an optical unit comprising a CCD (Charge Coupled Device), by which it scans an image formed on a recording sheet to generate image data representing the scanned image. Image-forming unit 16 includes photosensitive drum 161, charging unit 162, exposure unit 163, developing unit 164 having optical sensor F1 and magnetic sensor F2, transfer unit 165, fixing unit 166, and sheet-supplying unit 167, and forms an image on a recording sheet based on image data generated by image-scanning unit 15 or image data received from an external device such as a host device via a communications unit (not shown in the drawing).

Figure 2:
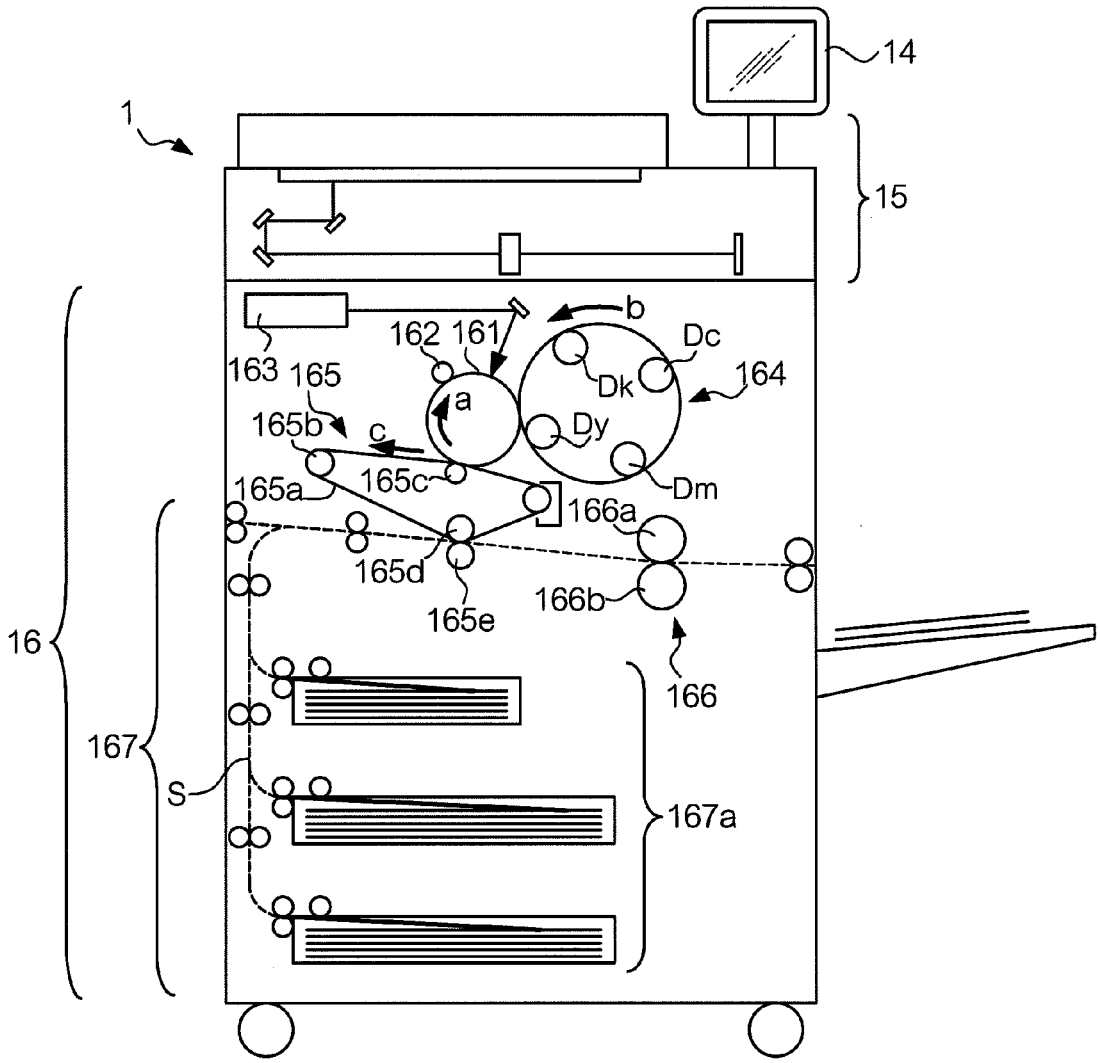
FIG. 2 shows a structure of image-forming apparatus 1 according to the exemplary embodiment.

FIG. 2 shows a structure of image-forming apparatus 1, which is viewed from its front.

Sheet-supplying unit 167 has sheet supply source 167*a* and sheet transport device for transporting a recording sheet from sheet supply source 167*a* through transportation path S which is indicated by broken lines in the drawing. The sheet transport device comprises component parts for transporting the recording sheets such as a transport roll and a resist roll. Photosensitive drum 161 is an example of an image holding member that holds an image, and is constituted of a cylindrical member including an electroconductive drum main body and a photoconductive layer formed on a surface of the drum main body, where the photoconductive layer may be made of an OPC (Organic Photo Conductor). The longitudinal direction or rotation axis direction of photosensitive drum 161 corresponds to a main scanning direction, which is a direction of scanning at a time that exposure unit 163 performs an exposure scanning by rotating a polygon mirror, and is perpendicular to the direction of sheet transportation (or sub-scanning direction). Photosensitive drum 161 rotates around a center of the drum main body at a predetermined circumferential speed in a direction indicated by an arrow "a" in the drawing while maintaining contact with intermediate transfer belt 165*a*. Charging unit 162 is constituted of a charging member that is arranged to contact a surface of photosensitive drum 161 and rotate together with the rotation of photosensitive drum 161 to charge the surface of photosensitive drum 161 with a predetermined polarity and electric potential. Exposure unit 163 is equipped with a laser light source, polygon mirror, etc., and irradiates image-modulated laser light toward a circumferential surface of photosensitive drum 161 to form an electrostatic latent image, and thus serves as an example of an electro latent image-forming unit. It is to be noted that the electrostatic latent image is a latent image formed by a difference in electric potential between exposed regions and non-exposed regions.

Transfer unit 165 includes intermediate transfer belt 165*a*, support rolls 165*b*, primary transfer roll 165*c*, secondary transfer roll 165*d*, and opposing roll 165*e*. Intermediate transfer belt 165*a* is an endless belt member, and an inner surface thereof is supported by plural support rolls 165*b*, primary transfer roll 165*c*, and secondary transfer roll 165*d* in a tensioned state such that intermediate transfer belt 165*a* is rotated in a direction indicated by an arrow "c." Primary transfer roll 165*c* is disposed so as to be opposed to photosensitive drum 161 with intermediate transfer belt 165*a* therebetween, and serves to transfer a toner image formed on the surface of photosensitive drum 161 to an outer surface of intermediate transfer belt 165*a* (primary transfer). Secondary roll 165*d* serves to transfer the toner image that has been transferred onto the outer surface to a recording sheet in a region where secondary roll 165*d* and opposing roll 165*e* sandwich intermediate transfer belt 165*a* therebetween (secondary transfer). Fixing unit 166 is equipped with heat roll 166*a* and pressure roll 166*b*, which are opposed to one another across transportation path S. In fixing unit 166, the recording sheet to which the toner image has been transferred is applied with a heat and pressure from heat roll 166*a* and pressure roll 166*b* whereby the toner image is fixed onto the recording sheet.

Figure 3:
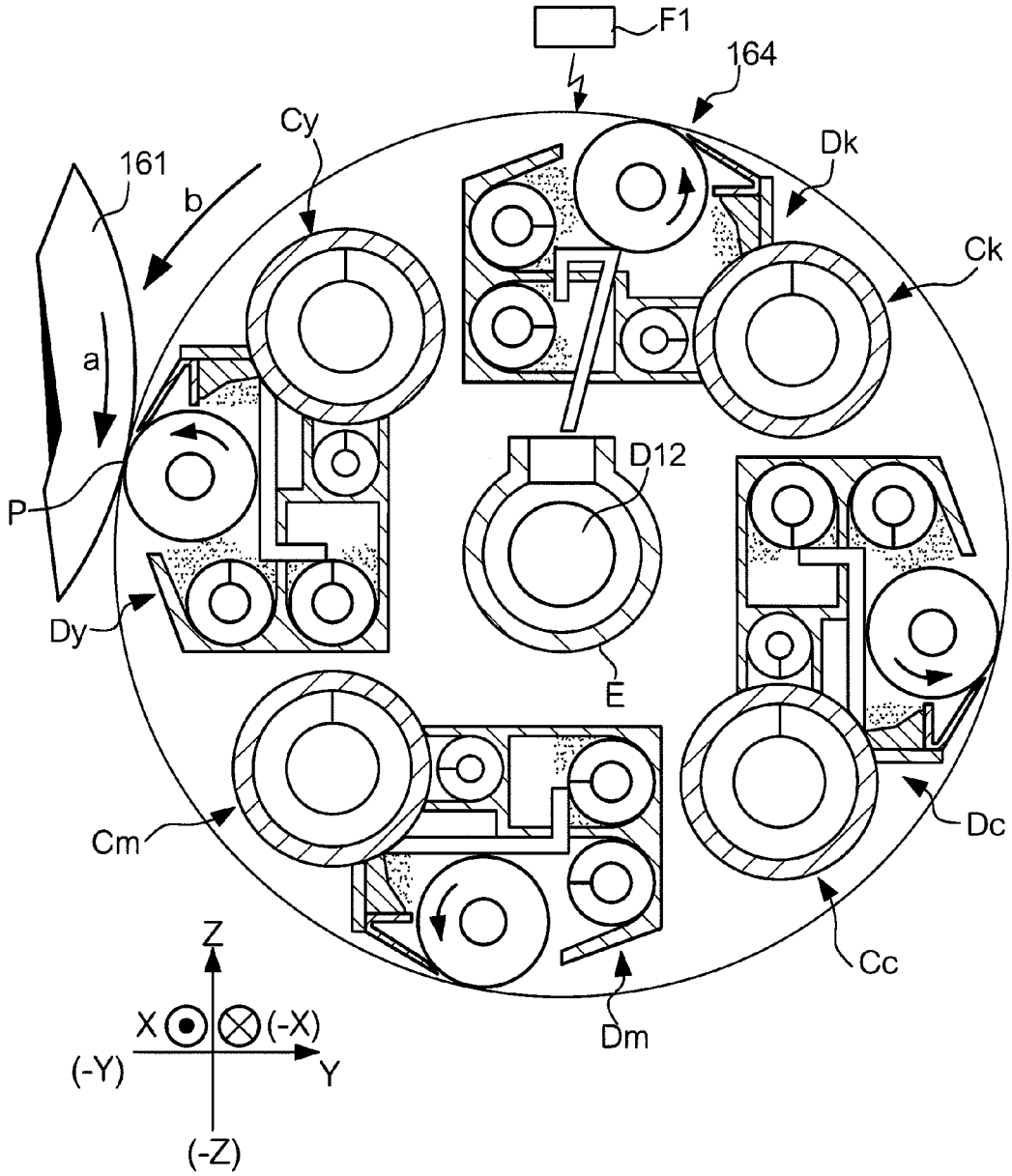
FIG. 3 shows a structure of developing unit 164 according to the exemplary embodiment.

FIG. 3 shows a detailed structure of developing unit 164 shown in FIG. 2.

It is to be noted here that when image-forming apparatus 1 is viewed from its front, the front-back direction of image-forming apparatus 1 is denoted as the X-axis direction, and arrows X and −X along the X-axis respectively indicate a front/back direction; the horizontal direction is denoted as the Y-axis direction, and arrows Y and −Y along the Y-axis respectively indicate a right/left direction and the vertical direction is denoted as the Z-axis direction, and arrows Z and −Z along the Z-axis respectively indicate an up/down direction. In this exemplary embodiment, the front-back direction is the main scanning direction in image-forming apparatus 1, the horizontal direction is the sub-scanning direction in image-forming apparatus 1, and the vertical direction is the direction of gravity. Also, in the drawing, a dot appearing in a circle indicates an arrow pointing toward a front of a sheet of paper from its back, and "x" appearing in a circle indicates an arrow pointing toward the back of the sheet of paper from its front. Further, in the following description, an angular position or direction of a component part with respect to rotation shaft D12 of developing unit 164 may be expressed by a corresponding number of an hour on a clock face. For example, developer unit Dk in FIG. 3 is positioned at "the 12 o'clock position."

Developing unit 164 uses a two-component developer that has a toner containing dyes or pigments together with a base polyester resin and a magnetic powder as a carrier. Also, developing unit 164 comprises plural developer units for developing an electrostatic latent image held on the surface of photosensitive drum 161 while integrally rotating around rotation shaft D12, and thus developing unit 164 constitutes a rotary developing device. It should be noted that in the following description, an amount of toner relative to the two-component developer having the toner and carrier will be referred to as a toner concentration. Arranged around rotation shaft D12 are developer units Dy, Dm, Dc, and Dk provided with toner containers Cy, Cm, Cc, and Ck which contain toners of yellow (Y), magenta (M), cyan (C), and black (K), respectively, such that the circumferentially adjoining developer units are separated from each other by 90 degrees. Thus, developer units Dy, Dm, and Dc are examples of a chromatic color developer unit that contains a developer including a chromatic color material and a magnetic powder, while developer unit Dk is an example of an achromatic color developer unit that contains a developer including an achromatic color material and a magnetic powder. It should be noted that the carrier (magnetic powder) of the developer is usually of an achromatic color such as black. Developer units Dy, Dm, Dc, and Dk are adapted to rotate around rotation shaft D12 in a direction indicated by an arrow "b" in the drawing, whereby developer units Dy, Dm, Dc, and Dk sequentially move to a predetermined development position P opposed to photosensitive drum 161 where the developer units is in a vicinity of photosensitive drum 161 and develops the electrostatic latent image formed on photosensitive drum 161. The toner concentration in developer units Dy, Dm, Dc is measured by an optical sensor F1 that measures a change in an optical property, such as a color saturation or brightness, of the developer, and is disposed at a position where the sensor can face these developer units one by one as the developer units rotate. It is to be noted that optical sensor F1 does not have to be exposed to a developer-accommodating space defined in each developer unit Dy, Dm, Dc, and it is possible, for example, to form a part of the developer unit with a light-transmissive member having a transmittance that is not less than a prescribed threshold value such that optical member F1 can measure the optical property of the developer in the developer unit through the light-transmissive member. Therefore, the toner concentration in the developer can be measured from a position apart from the developer-accommodating space of each developer unit Dy, Dm, Dc. Thus, optical sensor F1 may be a separate member from developer units Dy, Dm, Dc. In a case where the carrier and toner are of similar colors, however, it is difficult for optical sensor F1 to measure a change in the optical property of the developer and thus, optical sensor F1 cannot measure the toner concentration in developer unit Dk that contains a developer including a black toner and a black (or achromatic color similar to black) carrier. For this reason, the toner concentration in developer unit Dk is measured using magnetic sensor F2 (see FIG. 7) that measures a magnetic permeability, which is an example of a magnetic property that changes depending on the carrier concentration (and hence depending on the toner concentration). As will be explained later with reference to FIG. 7B, magnetic sensor F2 described in the exemplary embodiment is disposed inside collecting device E provided at a position adjacent to rotation shaft D12 in the backward direction for collecting excess toner from developer unit Dk. Because of such differences in how toner concentration is measured, the structures of developer units Dy, Dm, Dc and toner containers Cy, Cm, Cc partially differ from the structures of developer unit Dk and toner container Ck.

In the following description, where it is not necessary to distinguish among toner containers Cy, Cm, Cc, Ck and among developer units Dy, Dm, Dc, Dk, they are referred to as toner container C and developer unit D, respectively. Further, a member denoted by a reference numeral with a lower-case suffix y, m, c, or k, relates to yellow (Y), magenta (M), cyan (C), or black (K), respectively, and is a constituent part of toner container Cy, Cm, Cc, or Ck or developer unit Dy, Dm, Dc, or Dk. Moreover, when it is unnecessary to distinguish among chromatic color toner containers Cy, Cm, and Cc and among chromatic color developer units Dy, Dm, and Dc, they are referred to as toner container Cymc and developer unit Dymc, respectively. In the following explanation referring to FIGS. 4-7, it is assumed that the toner container C and developer unit D are at development position P opposed to photosensitive drum 161.

Figure 4:
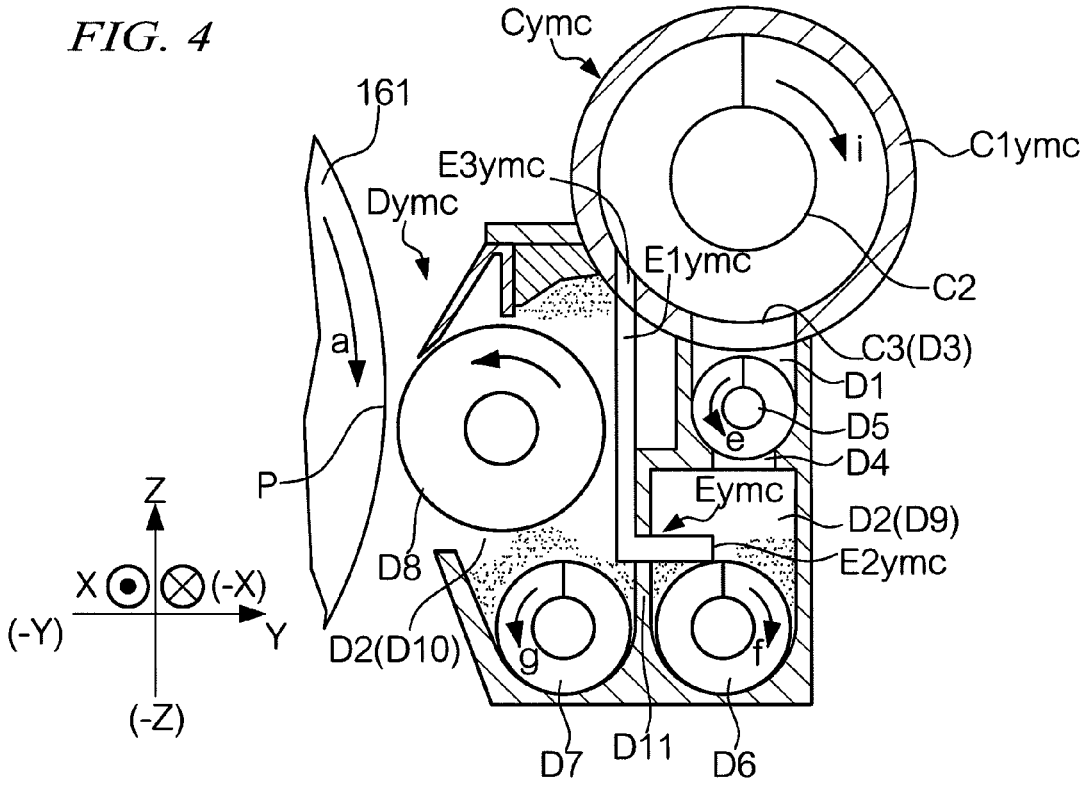
FIG. 4 is a front cross-sectional view of toner container Cymc and developer unit Dymc according to the exemplary embodiment.
Figure 5:
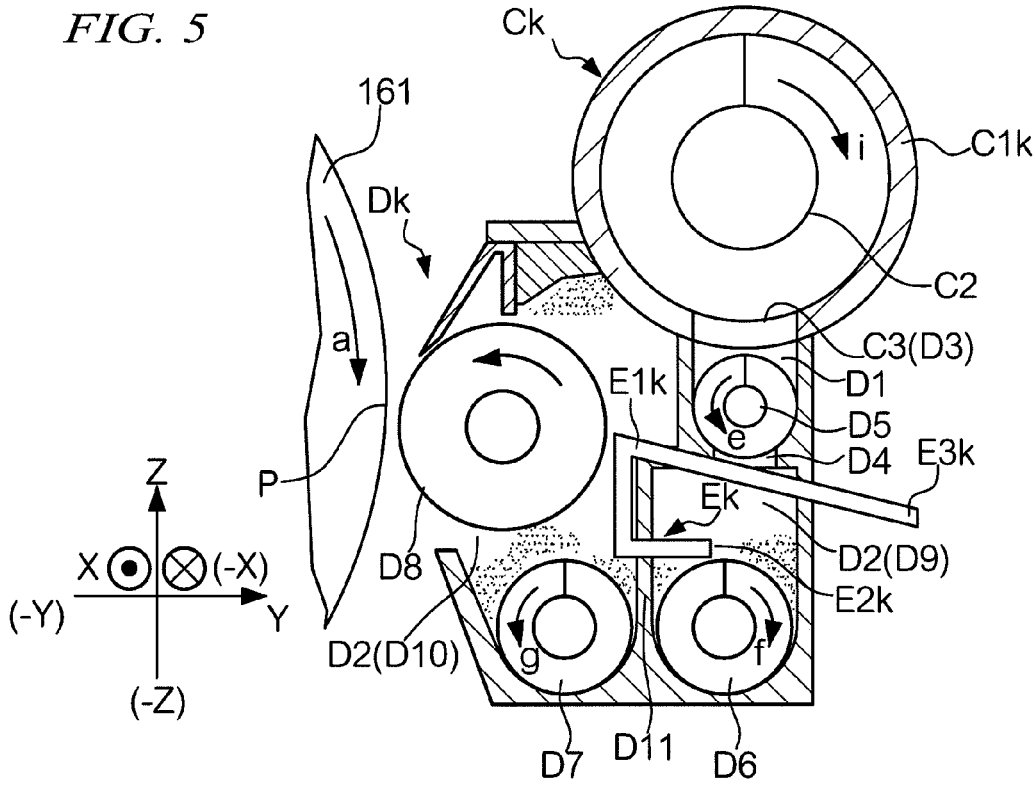
FIG. 5 is a front cross-sectional view of toner container Ck and developer unit Dk according to the exemplary embodiment.

FIG. 4 is a front cross-sectional view of toner container Cymc and developer unit Dymc, and FIG. 5 is a front cross-sectional view of toner container Ck and developer unit Dk when image-forming apparatus 1 is viewed from the front.

First, explanation will be made of a structure common between toner containers Cymc and Ck as well as between developer units Dymc and Dk. Toner container C has a detachable cylindrical housing C1 that contains a toner of a certain color, and convey member C2 provided in housing C1. The longitudinal direction of housing C1 is aligned with the rotation axis direction of photosensitive drum 161, and convey member C2 may consist of a wire generally extending in the longitudinal direction of housing C1 and wound to form a spiral in accordance with an inner diameter of housing C1, for example. When rotated in a direction indicated by arrow i in the drawings, convey member C2 conveys the toner contained in housing C1 toward discharge port C3, which is an opening provided in an end portion of housing C1, during stirring of the toner. The toner discharged from discharge port C3 of toner container C is supplied to adjustment chamber D1 of developer unit D.

Adjustment chamber D1 of developer unit D is tubular and has a longitudinal direction aligned with the rotation axis direction of photosensitive drum 161. Adjustment chamber D1 is formed with adjustment chamber inlet D3 connected with discharge port C3 of toner container C and adjustment chamber outlet D4 connected with development chamber D2 in respective end portions, and supply screw D5 serving as a convey member is provided inside adjustment chamber D1. Supply screw D5 has a spiral ridge for conveying the toner in adjustment chamber D1 from adjustment chamber inlet D3 toward adjustment outlet D4 when supply screw D5 is rotated in a direction indicated by arrow e in the drawing. In a state where an abundant amount of toner exists in adjustment chamber D1, a single rotation of supply screw D5 causes a predetermined amount of toner to be supplied from adjustment chamber D1 to development chamber D2.

In the above-described structure, control unit 11, housing C1, convey member C2, adjustment chamber D1, and supply screw D5 function as a toner supply unit. Control unit 11 controls elements that can affect the toner concentration in the developer contained in developer unit D, which may include, for example, the rotation speed and duration of rotation of rotating members such as convey member C2 or supply screw D5. In this way, the concentration of toner (color material) in the developer contained in the developer unit can be controlled, and thus control unit 11 controls the concentration of the color material included in the developer contained in the developer unit.

Development chamber D2 of developer unit D is supplied with a toner from adjustment chamber D1 and a carrier from a carrier source (not shown in the drawings). Development chamber D2 is formed with partition wall D11 that extends in the rotation axis direction of photosensitive drum 161 such that partition wall D11 divides development chamber D2 into first development chamber D9 and second development chamber D10. However, each end portion of partition wall D11 is formed with a hole through which first and second development chambers D9, D10 are connected to each other. Provided in first development chamber D9 is first stirring screw D6 having a longitudinal direction aligned with the rotation axis direction of photosensitive drum 161. First stirring screw D6 serves as a convey member that conveys the toner and carrier (hereinafter referred to as the developer) in first development chamber D9 in the backward direction when rotated in a direction indicated by arrow f in the drawing. Further, provided in second development chamber D10 is second stirring screw D7 having a longitudinal direction aligned with the rotation axis direction of photosensitive drum 161. Second stirring screw D7 serves as a convey member that conveys the developer in second development chamber D10 in the forward direction when rotated in a direction indicated by arrow g in the drawing. Thus, first and second stirring screws D6, D7 are configured to convey the developer in opposite directions so that the developer is circulated within development chamber D2. Also, first and second stirring screws D6, D7 serve to charge the developer by stirring the same during conveyance. In first development chamber D9, development roll D8 is also provided. Development roll D8 is constituted by a fixed magnet roll and a rotatable development sleeve that surrounds an outer circumference of the magnet roll. Development roll D8 attracts the developer to its surface by a magnetic attracting force of the magnet roll, and performs the development by causing the toner in the developer to adhere to regions of the surface of photosensitive drum 161 in accordance with the electrostatic latent image formed on the surface of photosensitive drum 161. Collecting device E is an example of a collecting unit, and is provided for the purpose of collecting and discharging, from development chamber D2 of developer unit D, the carrier that has become difficult to be charged as a result of being stirred with the toner for an extended period of time and the excess toner that has accumulated as a result of supply of the toner from toner container C. Collecting device E has different structures for toner container Cymc and for toner container Ck (or for developer unit Dymc and for developer unit Dk). In the following the differences in the structure will be explained.

Figure 6:
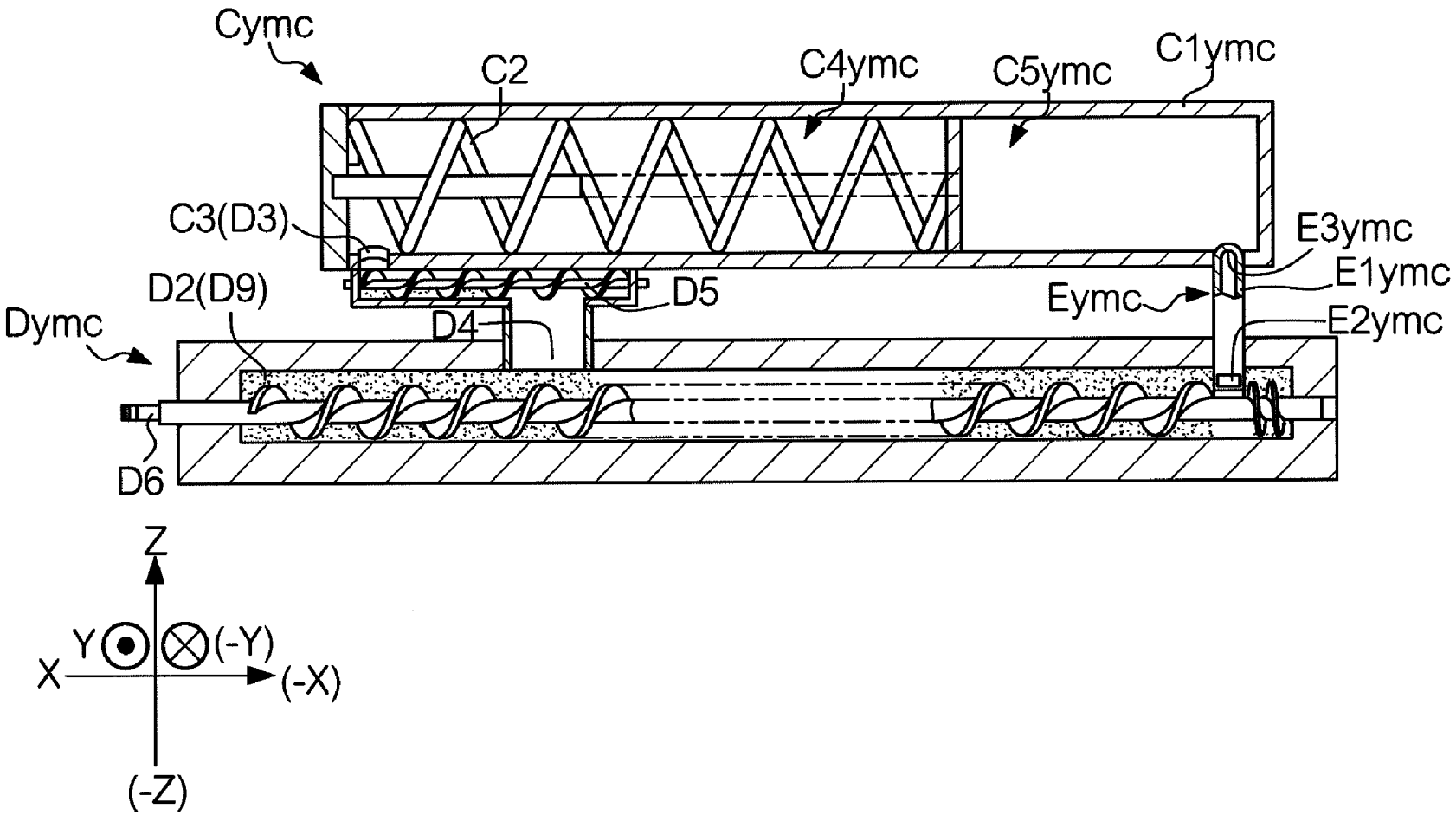
FIG. 6 is a side cross-sectional view of toner container Cymc and developer unit Dymc according to the exemplary embodiment.
Figures 7A, 7B:
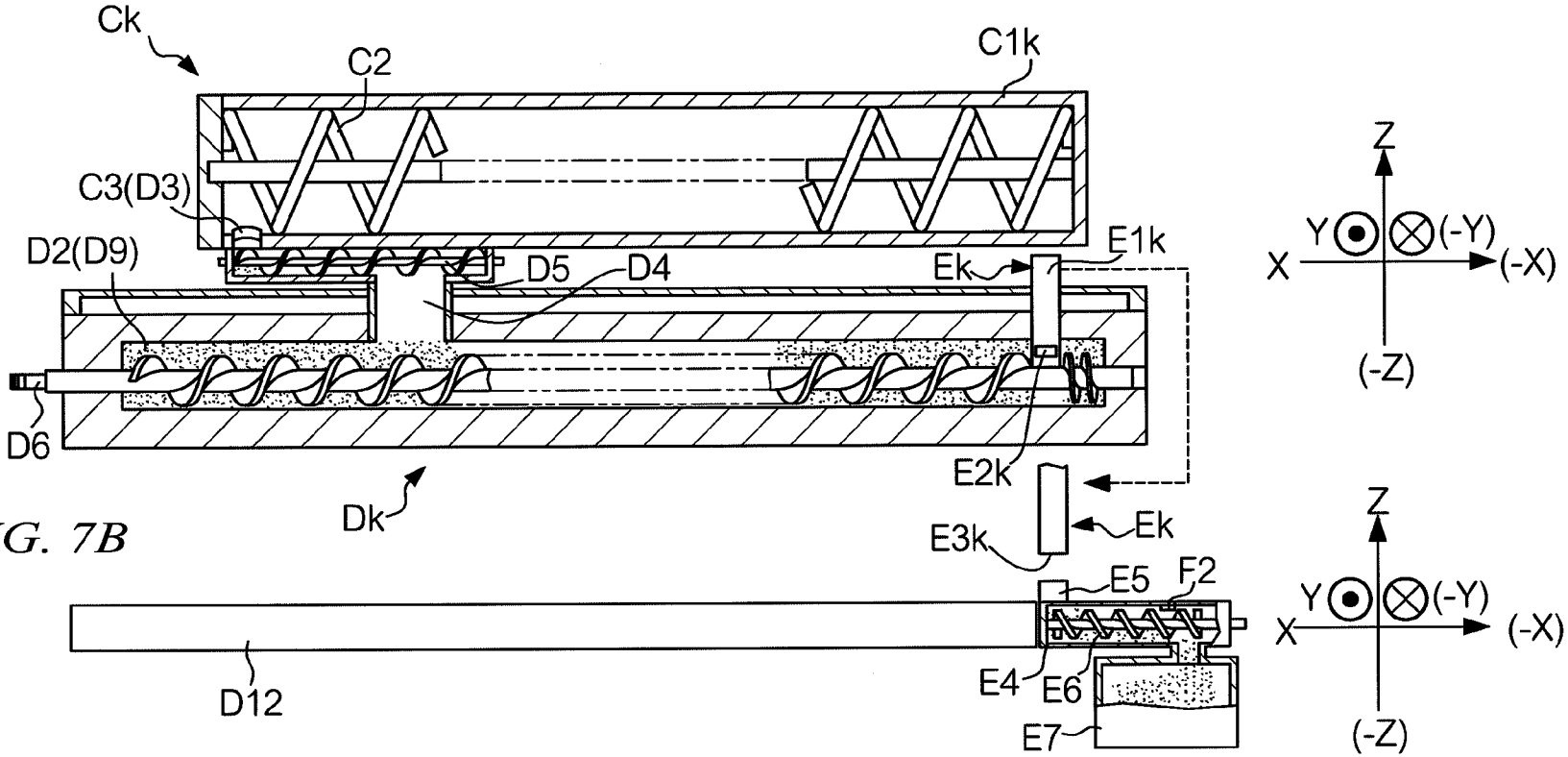
FIG. 7A is a side cross-sectional view of toner container Cymc and developer unit Dymc according to the exemplary embodiment.
FIG. 7B is a side cross-sectional view of developer collection passage E4 according to the exemplary embodiment.

FIG. 6 is a side cross-sectional view of toner container Cymc and developer unit Dymc, and FIG. 7A is a side cross-sectional view of toner container Ck and developer unit Dk.

Collecting device Eymc in FIG. 6 has tube inlet E2*ymc* for collecting the developer in development chamber D2, tube outlet E3*ymc* for discharging the collected developer to toner container Cymc, and discharge tube E1*ymc* that connects tube inlet E2*ymc* and tube outlet E3*ymc*. Tube inlet E2*ymc* at one end of discharge tube E1*ymc* is positioned inside development chamber D2 at an end portion in the backward direction. Tube inlet E2*ymc* has an opening facing in Y-axis positive direction to scoop and collect at least part of the developer circulatingly conveyed by first and second stirring screws D6, D7. On the other hand, tube outlet E3*ymc* at the other end of discharge tube E1*ymc* is provided in housing C1*ymc* of toner container Cymc to discharge the developer collected via tube inlet E2*ymc* to an inside of toner container Cymc (see FIGS. 4 and 6).

Toner container Cymc has first accommodation chamber C4*ymc* and second accommodation chamber C5*ymc*. First accommodation chamber C4*ymc* accommodates a toner to be supplied to developer unit Dymc. Second accommodation chamber C5*ymc* is connected to discharge tube E1*ymc* via tube outlet E3*ymc* to accommodate the developer collected from developer unit Dymc. First accommodation chamber C4*ymc* and second accommodation chamber C5*ymc* are not directly connected to each other, and only connected via developer unit Dymc and thus the toner in first accommodation chamber C4*ymc* moves to second accommodation chamber C5*ymc* only through developer unit Dymc.

Compared with collecting device Eymc of FIG. 6, collecting device Ek of FIG. 7A differs in the shape of discharge tube E1*k* such that collecting device Ek discharges the developer collected from developer chamber D2 to collection passage E4 shown in FIG. 7B. Collecting device Ek of FIG. 7A has tube inlet E2*k* for collecting the developer in development chamber D2, tube outlet E3*k* for discharging the collected developer to collection passage E4, and discharge tube E1*k* that connects tube inlet E2*k* and tube outlet E3*k*. Tube inlet E2*k* at one end of discharge tube E1*k* is positioned inside development chamber D2 at an end portion in the backward direction. Tube inlet E2*k* has an opening facing in Y-axis positive direction to scoop and collect at least part of the developer circulatingly conveyed by first and second stirring screws D6, D7. On the other hand, tube outlet E3*k* at the other end of discharge tube E1*k* is provided such that when the rotation of developing unit 164 causes developer unit Dk to be positioned at the 12 o'clock position, an opening of tube outlet E3*k* faces in the direction of gravity (see FIGS. 5, 7A and 7B).

Collection passage E4 shown in FIG. 7B is fixedly disposed on an axis of rotation shaft D12 of developing unit 164 such that collection passage E4 is separated from rotation shaft D12 in the axial direction of rotation shaft D12 (or in the rotation axis direction of photosensitive drum 161), whereby collection passage E4 does not rotate along with the rotation of developing unit 164 around rotation shaft D12. Thus, collection passage E4 provides a developer passage that remains stationary when each developer unit of developing unit 164 moves. Collection passage E4 has collection inlet E5 that opens in a direction opposite to the direction of gravity (i.e., opens in the upward direction). Collection inlet E5 is provided at a position in the rotation axis direction of photosensitive drum 161 substantially the same as that of tube outlet E3*k* provided at an end of discharge tube E1*k*. Also, collection inlet E5 is positioned such that it is substantially aligned in the horizontal direction (i.e., in Y-axis direction) with tube outlet E3*k* when developer unit Dk is at the 12 o'clock position. Thus, when developer unit Dk is moved to a position where collection inlet E5 and tube outlet E3 are substantially aligned with each other in the rotation axis direction of photosensitive drum 161 and in the horizontal direction, the developer discharged from tube outlet E3*k* in the direction of gravity is received and collected by collection inlet E5. In collection passage E4 connected to collection inlet E5, convey screw E6 for conveying the developer in the backward direction and magnetic sensor F2 serving as an example of a measuring unit that measures a change in permeability of the developer depending on an amount of magnetic powder serving as the carrier are provided. The developer conveyed in the backward direction is eventually collected in collection container E7.

Explanation will now be made of the reason magnetic sensor F2 for measuring the toner concentration of black (K) is provided within collecting device Ek. A magnetic sensor measures the permeability by performing an electrical measurement while in direct contact with the developer, and thus, a detection surface of the magnetic sensor needs be provided so as to be exposed to the developer containing space and directly contact the developer. However, in a rotary developing device, the developer units move around the rotation shaft when the rotation shaft rotates. Therefore, in a case where the magnetic sensor is provided inside a developer unit, means for supplying electric power to the magnetic sensor and obtaining the measurement result of permeability from the magnetic sensor should be such that it does not hinder the movement of the developer units, and this would lead to a complicated structure of such means. In contrast to such a case, in the exemplary embodiment, owing to the provision of magnetic sensor F2 in collection passage E4 of collecting device Ek which is fixedly provided so as not to rotate along with the rotation of developer unit Dk around rotation shaft D12, it is avoided that the structure for supplying electric power and obtaining the measurement result becomes complicated.

On the other hand, optical sensor F1 for measuring the concentration of toner of yellow (Y), magenta (M), and cyan (C) is only required to be disposed at a position where optical sensor F1 can face each developer unit and, unlike magnetic sensor F2, need not be disposed at a position where the sensor is in direct contact with the developer.

(2) Operation

Figure 8:
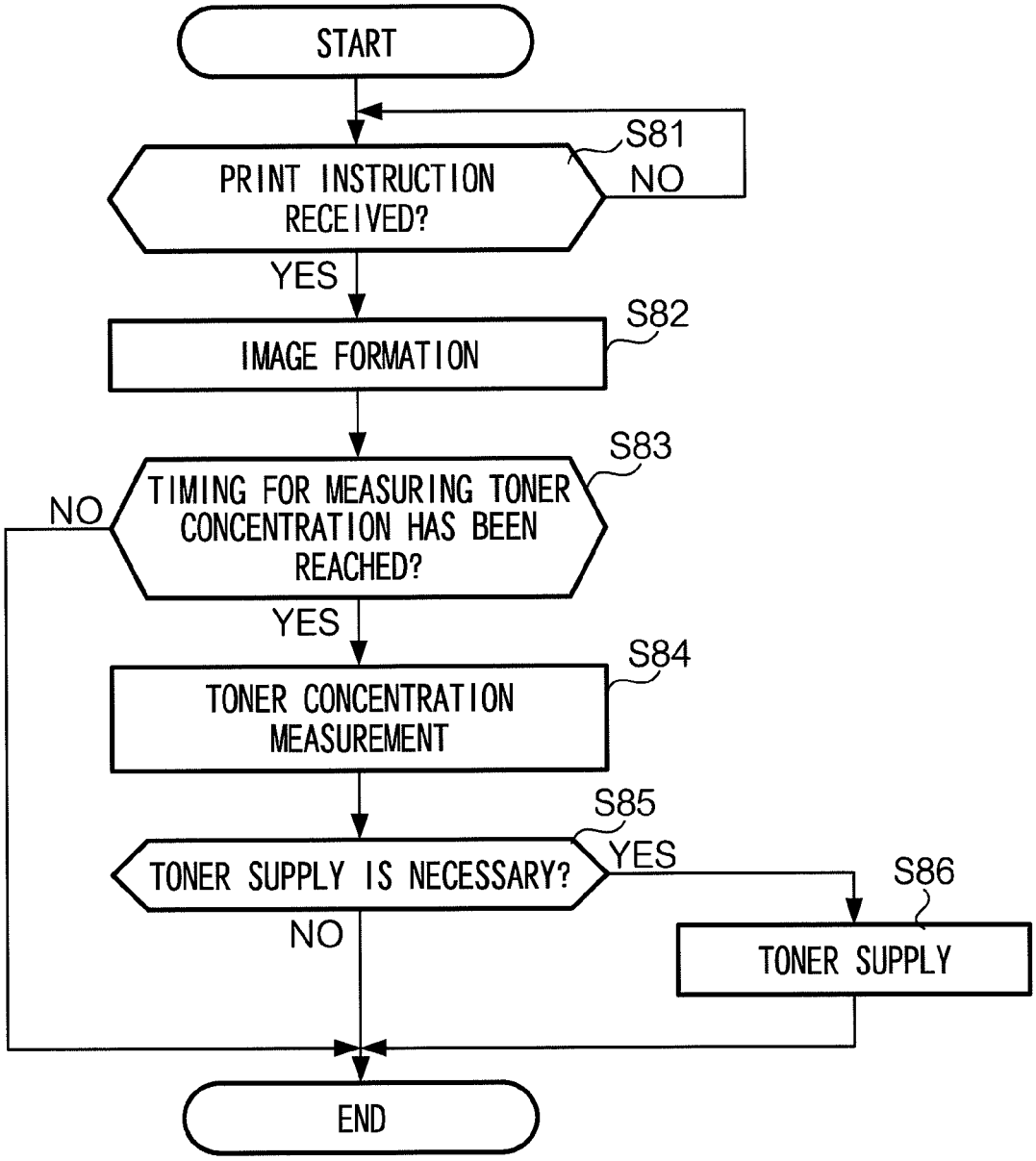
FIG. 8 is a flowchart for explaining an operation of image-forming apparatus 1 according to the exemplary embodiment in response to a print instruction.

FIG. 8 is a flowchart for explaining an operation of image-forming apparatus 1 in response to a print instruction.

Control unit 11 of image-forming apparatus 1 determines whether a print instruction is received (step S81), and repeats the process of step S81 until a print instruction is detected (step S81; NO). If a user operates operating unit 13 to instruct printing of image data, control unit 11 detects the print instruction (step S81; YES), and accordingly controls image-forming unit 16 to form an image in accordance with the image data on a recording sheet (step S82). In the process of step S82, control unit 11 causes each developer unit D to develop the electrostatic latent image formed on the surface of photosensitive drum 161 while rotating developer units D integrally around rotation shaft D12. It is to be noted that the process subsequent to step S82 is different for developer unit Dymc and for developer unit Dk, and therefore each process will be explained below.

First, with reference to FIGS. 3 and 4, explanation will be made of an operation of developer unit Dymc.

Control unit 11 rotates rotation shaft D12 to move developer unit Dymc to development position P, which is at the 9 o'clock position. Then, control unit 11 controls developer unit Dymc to develop the electrostatic latent image formed on the surface of photosensitive drum 161. Subsequently, control unit 11 rotates rotation shaft D12 to move developer unit Dymc from the 9 o'clock position to the 6 o'clock position. During this period, excess developer in development chamber D2*ymc* is scooped by collecting device Eymc provided in developer unit Dymc and caused to flow into discharge tube E1*ymc* via tube inlet E2*ymc*. Thereafter, control unit 11 rotates rotation shaft D12 to move developer unit Dymc from the 6 o'clock position to the 3 o'clock position. During this period, the developer in discharge tube E1*ymc* flows out from tube outlet E3*ymc* toward the 6 o'clock position, i.e. in the direction of gravity, and is accommodated by second accommodation chamber C5*ymc*. Then, control unit 11 controls the rotation of first and second stirring screws D6, D7 to circulatingly convey the developer, which has accumulated in first development chamber D9, to and from second development chamber D10*ymc*.

Referring again to FIG. 8, next, control unit 11 determines whether a predetermined timing for measuring the concentration of toner in developer unit Dymc has been reached (step S83). The predetermined timing may be once for every predetermined time period or each time an image is formed on a recording sheet. If control unit 11 determines that the predetermined timing for toner concentration measurement has not been reached (step S83; NO), the process is terminated without steps S84-S86 being performed. On the other hand, if control unit 11 determines that the predetermined timing for toner concentration measurement has been reached (step S83; YES), the toner concentration in development chamber D2 is measured (step S84). First, control unit 11 rotates rotation shaft D12 to cause developer unit Dymc to move to the 12 o'clock position opposed to optical sensor F1. Then, control unit 11 controls optical sensor F1 to have optical sensor F1 measure a change in optical property of the developer in development chamber D2*ymc*, thereby to calculate the toner concentration in development chamber D2*ymc*. Subsequently, control unit 11 compares the toner concentration in development chamber D2*ymc* measured in step S84 with a toner concentration threshold value pre-stored in storage unit 12, thereby to determine whether it is necessary to supply toner to development chamber D2*ymc* (step S85). When the toner concentration in development chamber D2*ymc* is equal to or greater than the toner concentration threshold value, and hence control unit 11 determines that it is not necessary to supply toner to development chamber D2*ymc* (step S85; NO), the process is terminated without step S86 being performed. On the other hand, if the toner concentration in development chamber D2*ymc* is lower than the toner concentration threshold value, and hence control unit 11 determines that it is necessary to supply toner to development chamber D2*ymc* (step S85; YES), control unit 11 controls the rotation of convey member C2 in toner container Cymc and supply screw D5*ymc* in adjustment chamber D1*ymc* such that the toner in toner container Cymc is supplied to development chamber D2*ymc* (step S86).

Next, with reference to FIGS. 3 and 5, explanation will be made of an operation of developer unit Dk.

Control unit 11 rotates rotation shaft D12 to move developer unit Dk to development position P, which is at the 9 o'clock position. Then, control unit 11 controls developer unit Dk to develop the electrostatic latent image formed on the surface of photosensitive drum 161. Subsequently, control unit 11 rotates rotation shaft D12 to move developer unit Dk from the 9 o'clock position to the 6 o'clock position. During this period, excess developer in development chamber D2*k* is scooped by collecting device Ek provided in developer unit Dk and flows into discharge tube E1*k* via tube inlet E2*k*. Thereafter, control unit 11 rotates rotation shaft D12 to move developer unit Dk from the 6 o'clock position to the 12 o'clock position. During this period, the developer in discharge tube E1*k* flows out from tube outlet E3*k* toward the 6 o'clock position, i.e. in the direction of gravity, and is received by collection passage E4 via collection inlet E5. Then, control unit 11 rotates rotation shaft D12 to move developer unit Dk from the 12 o'clock position to the 9 o'clock position. During this period, control unit 11 controls the rotation of first and second stirring screws D6, D7 to circulatingly convey the developer, which has been accumulated in first development chamber D9 during the rotation of developer Dk, to and from second development chamber D10*k*.

Next, control unit 11 determines whether a predetermined timing for measuring the concentration of toner in development chamber D2*k* has been reached (step S83). If control unit 11 determines that the predetermined timing for toner concentration measurement has not been reached (step S83; NO), the process is terminated without steps S84-S86 being performed. On the other hand, if control unit 11 determines that the predetermined timing for toner concentration measurement has been reached (step S83; YES), the toner concentration in development chamber D2*k* is measured (step S84). First, control unit 11 controls the rotation of convey screw E6 in collection passage E4 to convey the developer in collection passage E4 in the backward direction. Then, control unit 11 controls magnetic sensor F2 to have magnetic sensor F2 measure a change in permeability of the developer in collection passage E4 thereby to calculate the toner concentration in collection passage E4. It should be noted that because excess developer in the development chamber D2*k* is collected in collection passage E4 without alteration, the toner concentration measured in collection passage E4 is substantially equal to the toner concentration in development chamber D2*k*. Subsequently, control unit 11 compares the toner concentration in development chamber D2*k* measured in step S84 with a toner concentration threshold value pre-stored in storage unit 12, thereby to determine whether it is necessary to supply toner to development chamber D2*k* (step S85). When the toner concentration in development chamber D2*k* is equal to or greater than the toner concentration threshold value, and hence control unit 11 determines that it is not necessary to supply toner to development chamber D2*k* (step S85; NO), the process is terminated without step S86 being performed. On the other hand, if the toner concentration in development chamber D2*k* is lower than the toner concentration threshold value, and hence control unit 11 determines that it is necessary to supply toner to development chamber D2*k* (step S85; YES), control unit 11 controls the rotation of convey member C2*k* in toner container Ck and supply screw D5*k* in adjustment chamber D1*k* such that the toner in toner container Ck is supplied to development chamber D2*k* (step S86).

According to the above-described exemplary embodiment, control unit 11 calculates the toner concentration in development chamber D2*k* by controlling magnetic sensor F2 provided in collection passage E4. Therefore, the concentration of toner contained in the development chamber of the developer unit that utilizes an achromatic two-component developer can be measured without provision of a magnetic sensor in the development chamber.

(3) Modified Embodiments

(3-1) First Modified Embodiment

In the foregoing exemplary embodiment, developer units Dy, Dm, Dc, and Dk provided with toner containers Cy, Cm, Cc, and Ck that contain toners of respective colors are arranged around rotation shaft D12 with circumferentially adjacent developer units being separated from each other by 90 degrees. Also, collecting device Eymc collects excess developer from development chamber D2*ymc* and discharges the collected developer to second accommodation chamber C5*ymc* of toner container Cymc. However, the arrangement of toner container C and the method for discharging the collected developer are not limited to such an embodiment.

Figure 9:
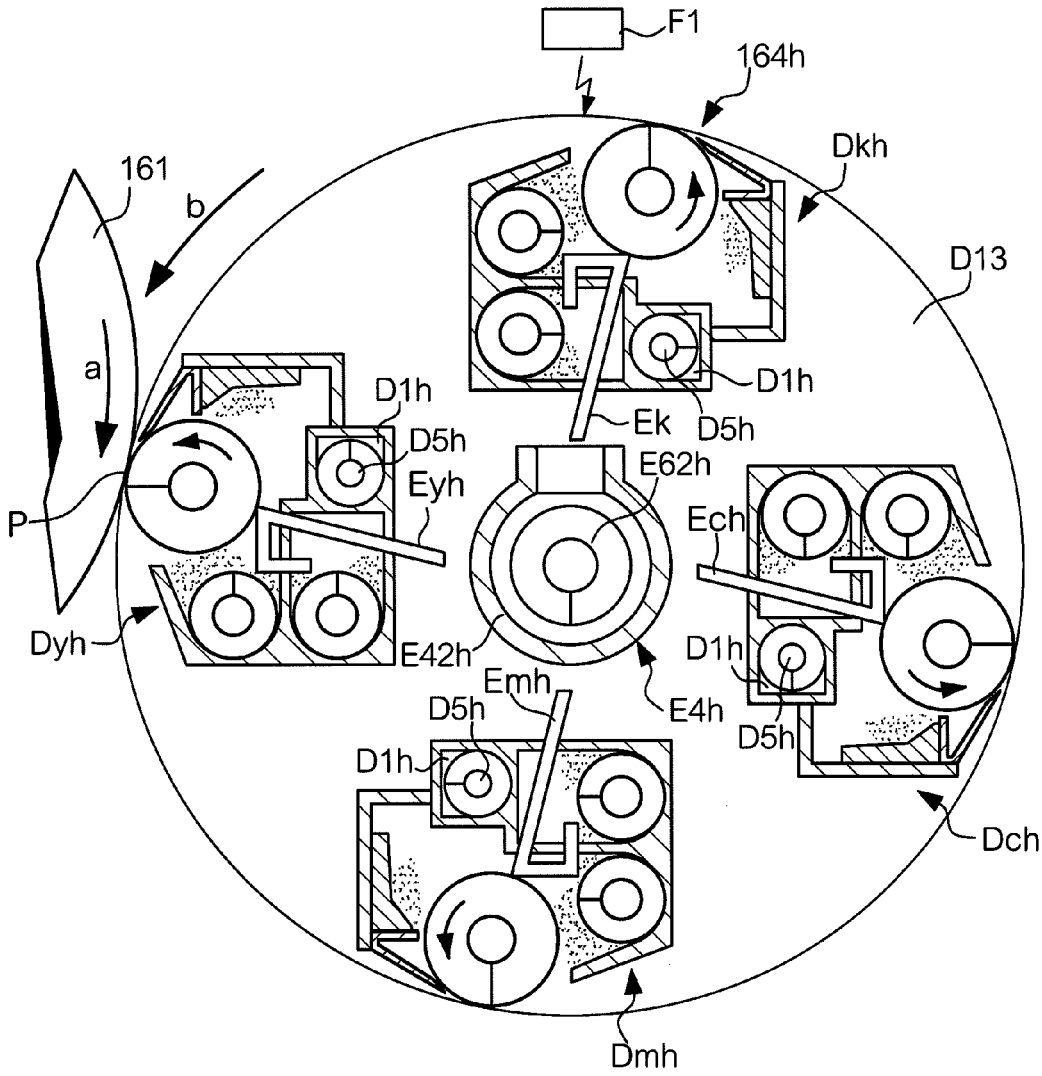
FIG. 9 shows a structure of developing unit 164*h* according to a modified embodiment.

FIG. 9 is a front view of developing unit 164*h* regarding a modified embodiment of the invention.

Developing unit 164*h* is a rotary developing device in which plural developer units are attached to a rotation board D13 such that the developer units rotate integrally about a rotation axis passing through a center of rotation of rotation board D13 and develop an electrostatic latent image formed on a surface of a photosensitive drum with respective two-component developers. Specifically, developing unit 164*h* has developer units Dyh, Dmh, Dch, and Dkh, which are supplied with toners of yellow (Y), magenta (M), cyan (C), and black (K), respectively, by supply screw D5*h* provided in adjustment chamber D1*h*. In this first modified embodiment, developer unit Dh is different from developer unit D in the foregoing exemplary embodiment in that developer unit Dh is not provided with toner container C and toner is supplied to adjustment chamber D1*h* from a toner supply source not shown in the drawing. Also, in the first modified embodiment, collecting device Eymch provided for developer unit Dymch that contains the toner of Y, M, and C is configured to discharge the collected developer to collection passage E4*h* in the same manner as in collecting device Ek provided for developer unit Dk that contains the toner of black (K) in the foregoing exemplary embodiment.

Figures 10A, 10B, 10C:
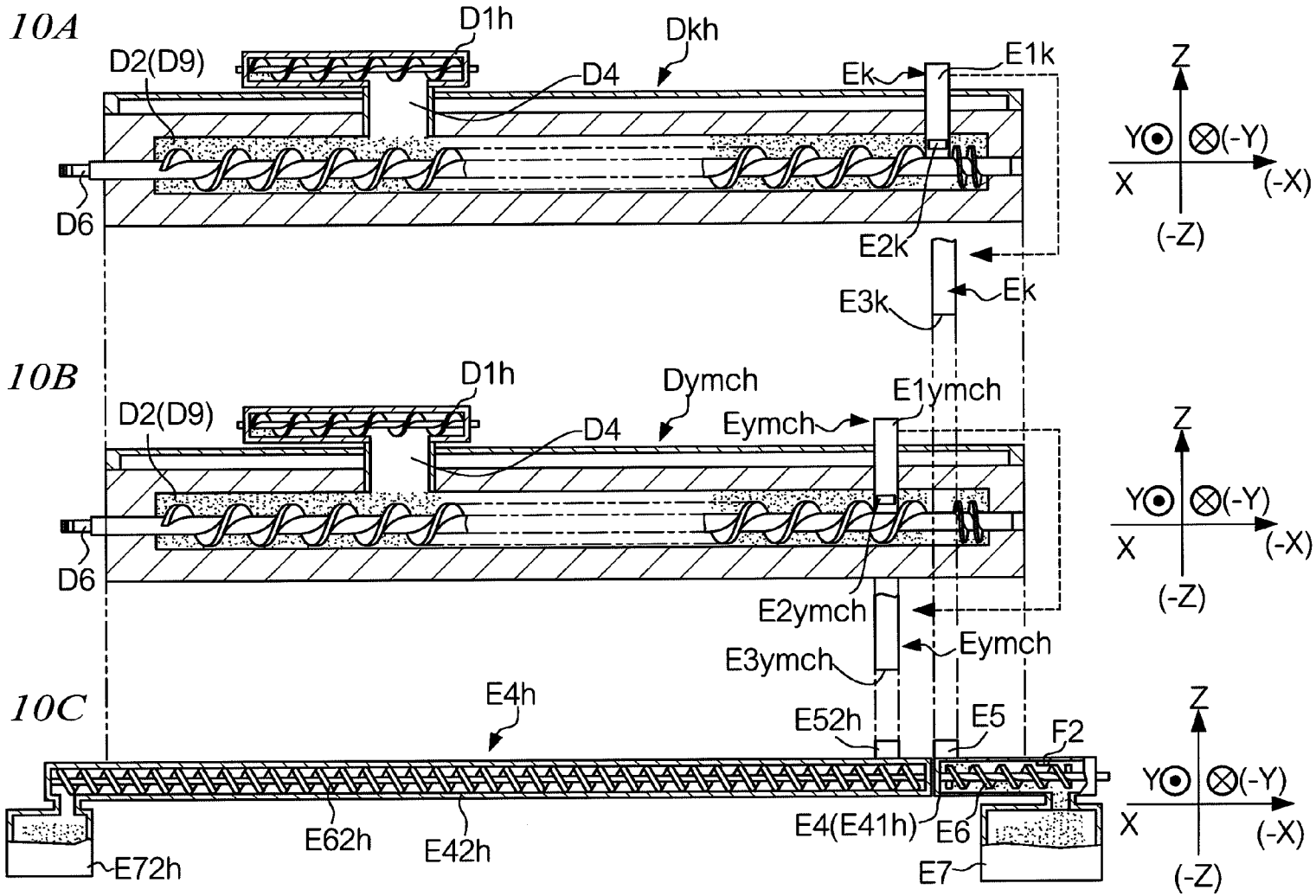
FIGS. 10A-10C show a side cross-sectional view of developer unit Dh according to the modified embodiment.

FIGS. 10A-10C show a side cross-sectional view of developer unit Dh according to the first modified embodiment.

FIG. 10A is a side cross-sectional view of developer unit Dkh, and FIG. 10B is a side cross-sectional view of developer unit Dymch. Collecting device Ek and collecting device Eymch are configured to discharge developer to collection passage E4*h* at different positions in the rotation axis direction of photosensitive drum 161 (or front-back direction of image-forming apparatus 1). In the first modified embodiment, tube outlet E3*ymch* of collecting device Eymch and tube outlet E3*k* of collecting device Ek are arranged in this order in the backward direction.

FIG. 10C shows collection passage E4*h*. Collection passage E4*h* has collection passage E41*h* for collecting the developer discharged from developer unit Dkh and collection passage E42*h* for collecting the developer discharged from developer unit Dkh. Collection passage E41*h* has the same structure as collection passage E4 explained with reference to the foregoing exemplary embodiment, and thus detailed explanation thereof is omitted. Collection passage E42*h* is fixedly provided so as not to rotate when developing unit 164 rotates together with the rotation of rotation shaft D12, and has collection inlet E52*h* that opens in a direction opposite to the direction of gravity (an upward direction). Collection inlet E52*h* is provided at substantially the same position as tube outlet E3*ymch* in the rotation axis direction of photosensitive drum 161. Also, collection inlet E52*h* is substantially aligned with tube outlet E3*ymch* in the horizontal direction (Y-axis direction) when developer unit Dymch is positioned at the 12 o'clock position. Thus, the developer discharged from tube outlet E3*ymch* in the direction of gravity is received and collected by collection inlet E52*h*. Further, collection passage E42*h*, which is connected to collection inlet E52*h*, is provided with convey screw E62*h* for conveying the developer in the forward direction. The developer conveyed in the forward direction is eventually collected into collection container E72*h*.

In the above-described first modified embodiment, the concentration of toner contained in the development chamber of the developer unit that utilizes an achromatic two-component developer and is not provided with a toner container can be measured without provision of a magnetic sensor in the development chamber.

(3-2) Second Modified Embodiment

In the foregoing exemplary embodiment, convey member C2, supply screw D5, first stirring screw D6, second stirring screw D7, and convey screw E6 are used as members for conveying the developer. However, the developer conveying member is not limited to these members and may be any member(s) that enables the conveyance of developer under the control of control unit 11.

(3-3) Third Modified Embodiment

In the foregoing exemplary embodiment, a magnetic sensor is provided in a passage for collecting the black developer contained in developer unit Dk. However, the developer that moves through the passage provided with a magnetic sensor is not limited to the black developer and may be a developer of any other color so long as the toner concentration of the developer can be measured based on the permeability. Thus, the magnetic sensor may be provided in a passage for collecting a part of the developer contained in at least one of the developer units. In a case where a magnetic sensor is provided in each passage for collecting the developer contained in an associated one of the developer units, the collection passages, each having a structure as illustrated in FIG. 7B, may be arranged along an axis of rotation of the developer units, in a manner such as that of collection passages E41*h* and E42*h* in FIG. 10C.

(3-4) Fourth Modified Embodiment

In the foregoing exemplary embodiment, collection passage E4 has collection inlet E5 constituted of an opening, and is disposed on the axis of rotation shaft D12 such that when developer unit Dk rotates around rotation shaft D12 to reach a position where developer unit Dk is opposed to collection inlet E5, the black developer in developer unit Dk falls into collection passage E4 through collection inlet E5. However, the structure of the collection passage is not limited to such an example, and the collection passage may be constituted of any passage that remains stationary when the developer unit is moved.

(3-5) Fifth Modified Embodiment

In the foregoing exemplary embodiment, developer unit D is supplied with a toner, serving as a color material, from toner container C and a magnetic powder, serving as a carrier, from a supply source not shown in the drawings However, toner container C may contain not only a toner but also a magnetic powder and supply them to developer unit D.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer unit that contains a developer including a color material and a magnetic powder, the color material being used to develop an electrostatic latent image held by an image holding member;

a collecting unit that collects a part of the developer contained in the developer unit via a passage;

a measuring unit that measures a concentration of the color material included in the developer based on a magnetic property of the developer moving through the passage; and a plurality of developer units each containing a developer including a color material and a magnetic powder, the plurality of developer units being moveable to a vicinity of the image holding member sequentially to develop the electrostatic latent image held by the image holding member using the respective color material, wherein the passage is configured to remain stationary when the plurality of developer units are moved, and a part of the developer contained in only one of the plurality of developer units moves through the passage.

2. The developing device according to claim 1, wherein the plurality of developer units includes a plurality of chromatic color developer units each containing a developer that includes a chromatic color material and a magnetic powder, and an achromatic color developer unit containing a developer that includes an achromatic color material and a magnetic powder, and wherein only the developer contained in the achromatic color developer unit moves through the passage.

3. The developing device according to claim 2, wherein:

the plurality of developer units are supported by a rotating member such that the plurality of developer units are moved to a vicinity of the image holding member sequentially as the rotating member rotates; and the passage is constituted of a non-rotating passage that is disposed on an axis of rotation of the rotating member so as to be separated from the rotating member, the passage being provided with an opening so that when the achromatic color developer unit moves as a result of rotation of the rotating member and comes to a position where the achromatic color developer unit is opposed to the opening, a part of the developer contained in the achromatic color developer unit falls into the passage via the opening.

4. The developing device according to claim 2, further comprising a chromatic color material concentration measuring unit located to face the chromatic color developer units one by one as the chromatic color developer units move, and to measure a concentration of the color material included in the developer contained in each chromatic color developer unit based on an optical property of the developer.

5. The developing device according to claim 3, further comprising a chromatic color material concentration measuring unit located to face the chromatic color developer units one by one as the chromatic color developer units move, and to measure a concentration of the color material included in the developer contained in each chromatic color developer unit based on an optical property of the developer.

6. An image-forming apparatus comprising:

an image holding member that holds an image;

a charging unit that charges the image holding member;

an electrostatic latent image-forming unit that exposes the image holding member charged by the charging unit to form an electrostatic latent image, the developing device according to claim 1 that develops the electrostatic latent image;

a transfer unit that transfers the image developed by the developing device to a recording medium;

a fixing unit that fixes the image transferred to the recording medium by the transfer unit;

a control unit that controls a concentration of the color material included in the developer contained in the developer unit of the developing device according to the concentration of the color material measured by the measuring unit, and a plurality of developer units each containing a developer including a color material and a magnetic powder, the plurality of developer units being moveable to a vicinity of the image holding member sequentially to develop the electrostatic latent image held by the image holding member using the respective color material, wherein the passage is configured to remain stationary when the plurality of developer units are moved, and a part of the developer contained in only one of the plurality of developer units moves through the passage.

7. The image-forming apparatus according to claim 6, wherein the plurality of developer units includes a plurality of chromatic color developer units each containing a developer that includes a chromatic color material and a magnetic powder, and an achromatic color developer unit containing a developer that includes an achromatic color material and a magnetic powder, and wherein only the developer contained in the achromatic color developer unit moves through the passage.

8. The image-forming apparatus according to claim 7, wherein:

the plurality of developer units are supported by a rotating member such that the plurality of developer units are moved to a vicinity of the image holding member sequentially as the rotating member rotates; and the passage is constituted of a non-rotating passage that is disposed on an axis of rotation of the rotating member so as to be separated from the rotating member, the passage being provided with an opening so that when the achromatic color developer unit moves as a result of rotation of the rotating member and comes to a position where the achromatic color developer unit is opposed to the opening, a part of the developer contained in the achromatic color developer unit falls into the passage via the opening.

9. The image-forming apparatus according to claim 7, the developing device further comprising a chromatic color material concentration measuring unit located to face the chromatic color developer units one by one as the chromatic color developer units move, and to measure a concentration of the color material included in the developer contained in each chromatic color developer unit based on an optical property of the developer.

10. The image-forming apparatus according to claim 6, wherein the collecting unit includes a collection container that accommodates the developer collected from the developer unit.

* * * * *